United States Patent [19]

Figini

[11] Patent Number: 4,497,589

[45] Date of Patent: Feb. 5, 1985

[54] ELECTRONIC TYPEWRITER WITH MEANS FOR POSITIONING THE TYPED MEMBER

[75] Inventor: Mario Figini, B. Marengo, Italy

[73] Assignee: Ing. C. Olivetti & C., S.p.A., Ivrea, Italy

[21] Appl. No.: 408,428

[22] Filed: Aug. 16, 1982

Related U.S. Application Data

[62] Division of Ser. No. 120,781, Feb. 12, 1980, abandoned.

[51] Int. Cl.[3] ..... B41J 29/44; B41J 29/48

[52] U.S. Cl. ..... 400/706; 400/61; 400/83; 400/582

[58] Field of Search ..... 400/83, 582, 583, 706, 400/61, 62, 68, 67, 902, 706.1, 707

[56] References Cited

U.S. PATENT DOCUMENTS

| | | | |
|---|---|---|---|
| 1,113,163 | 10/1914 | Neidig | 400/707.1 X |
| 2,626,036 | 1/1953 | Sternfeld | 400/706 X |
| 2,732,055 | 1/1956 | Williams | 400/707 X |
| 4,051,945 | 10/1977 | Fujimoto et al. | 400/279 |
| 4,311,399 | 1/1982 | Wegryn et al. | 400/568 X |

OTHER PUBLICATIONS

*IBM Tech. Disc. Bulletin*, by V. V. Halich et al., vol. 17, No. 9, Feb., 1975, pp. 2615–2619, 400–568.

*IBM Tech. Disc. Bulletin*, by W. R. McCray et al., vol. 22, No. 2, Jul., 1979, pp. 664–665, 400–706.

*Primary Examiner*—Paul T. Sewell

*Attorney, Agent, or Firm*—Banner, Birch, McKie & Beckett

[57] ABSTRACT

The keyboard of an electronic typewriter with a daisy-wheel print unit on a carriage includes a CENTER key and REPEAT key. With the print unit positioned where an insertion is to be made in a line being set up blind, these keys are actuated and the character to be inserted are typed in. The usable area for typing is continually shown on a two-digit display device. When a service key is then depressed, the line is printed with the inserted character entered by appropriate compression or expansion of empty spaces adjacent the characters to be inserted. The typewriter further comprises a line space memory and a control circuit which signals the number of line spacing commands which can still be carried into effect before the last line to be typed on the sheet.

8 Claims, 8 Drawing Figures

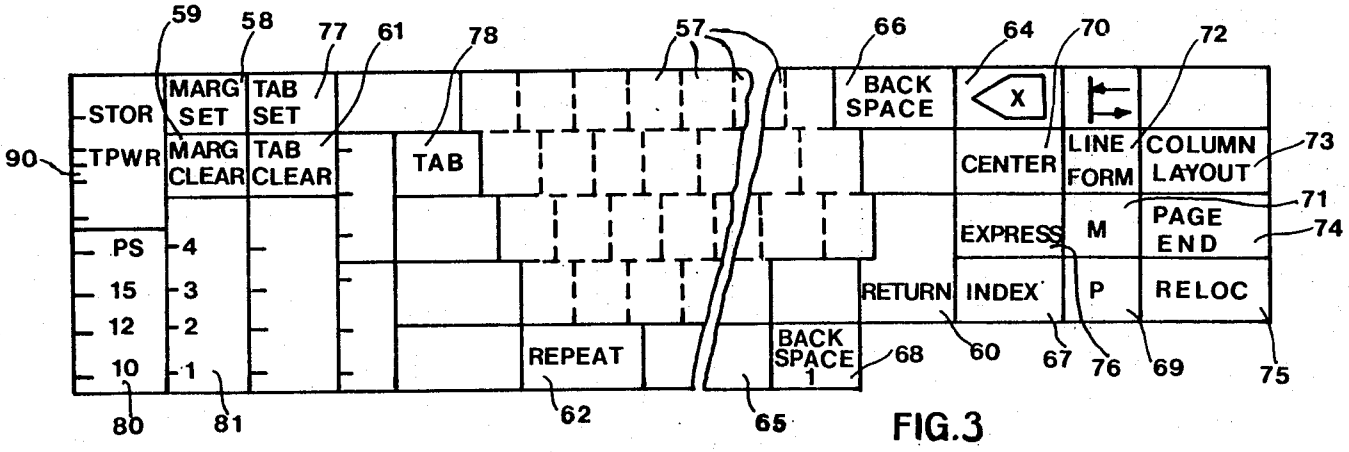
FIG.3
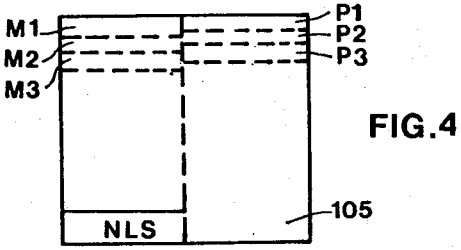
FIG.4
FIG.5
ING. C. OLLIVETTI & C., S.P.A.
ING. C. OLIVETTI & C., S.P.A.
FIG.6
ING. C. OLIVETI & C., S.P.A.
ING. C. OLIVETTI & C., S.P.A.

ELECTRONIC TYPEWRITER WITH MEANS FOR POSITIONING THE TYPED MEMBER

This application is a division of application Ser. No. 120,781, filed 2/12/80, now abandoned.

BACKGROUND OF THE INVENTION

The invention relates to an electronic typewriter with a means for positioning the typing member, and to the means for controlling such a positioning means.

Electronic typewriters are known, which are provided with means for positioning the typing member, which are controlled by a program of operating commands of the machine, which make it possible for a plurality of predetermined points on the recording carrier medium to be typed. These machines are generally found to be expensive and require calculations to be worked out or complicated operations to be performed in order to achieve the desired performance. This is found to be worse in the specific case of typing with differential pitch.

SUMMARY OF THE INVENTION

The object of the present invention is to provide an electronic typewriter which is of relativey low price and which is easy to use, and which is provided with a means for positioning the typing member, which can automatically and in the first strike perform the more complicated functions of editing a typewritten text.

According to the present invention, there is provided an electronic typewriter with a means for positioning the typing member, a keyboard, a memory for storing the keyboard input data, a memory for spaces available for the typing, a counter for indicating the spaces associated with the data to be typed, and a control means for carrying out typing of the stored data, in a space which is centered with respect to the available space.

The invention further provides an electronic typewriter comprising a means for positioning the typing member, a memory for storing the position parameters of the typing member with respect to the line to be typed, and a selection means for changing the said parameters to permit tabled preparation of the text to be typed, in such a way as to fix minimum distances of the edges of each word of the text from the limits of the table and centre the edges of the table with respect to the edges of the foregoing position parameters.

The invention further provides an electronic typewriter comprising a means for positioning the typing member, which is capable of moving the typing member from a working position to a correction position for correcting parts of the text which have been previously typed, and a relocation element capable of automatically returning the typing member from the correction position to the working position.

The invention further provides an electronic typewriter comprising a means for line spacing the recording sheet, a line space memory capable of storing the number of elementary line spaces which can be typed on the recording sheet, a selection means for defining the line space pitch, a control circuit and a display device controlled by the control circuit, which is responsive to the line space commands and to the selected pitch, to signal the number of line spacing commands which can still be carried into effect before the last line to be typed on the sheet.

The invention further provides an electronic typewriter comprising a means for positioning the typing member, which is controlled by a memory which can be cancelled each time the machine is switched off, a non-volatile memory for storing groups of parameters relating to positioning of the typing member, a selector for selecting one of the said groups for the operative control of the typing member, and a storage means for non-volatile recording of the parameters of the selected group and using them whenever the machine is switched on again.

BRIEF DESCRIPTION OF THE DRAWING

The invention will be described in more detail, by way of example, with reference to the accompanying drawings, in which:

FIG. 3 shows the keyboard layout of the typewriter;

FIG. 4 shows the organization of a non-volatile memory of the control unit; and FIGS. 5 and 6 illustrate examples of the operation of the machine of FIG. 1;

DESCRIPTION OF A PREFERRED EMBODIMENT

Figure 1:
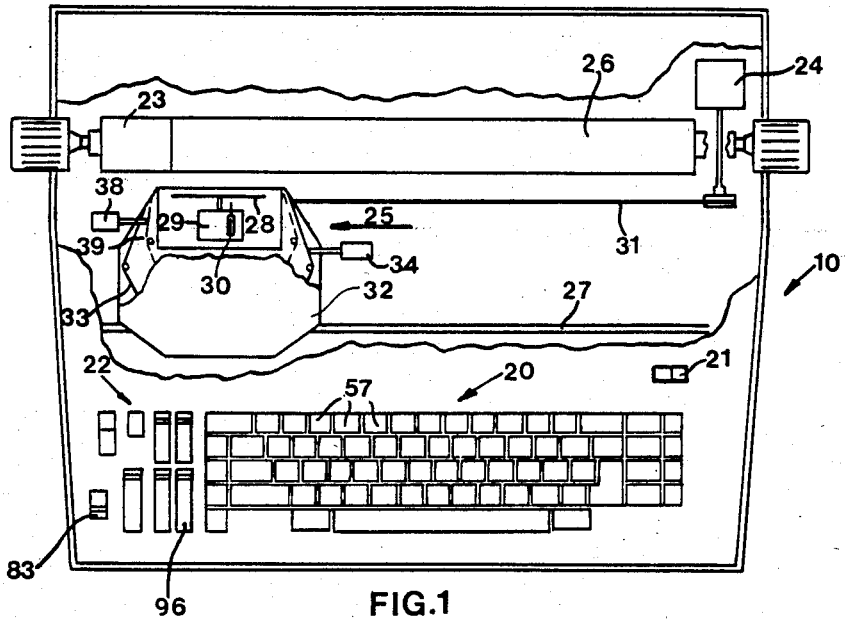
FIG. 1 is a plan view of an electronic typewriter with a typing member positioning means embodying the invention.
Figure 2:
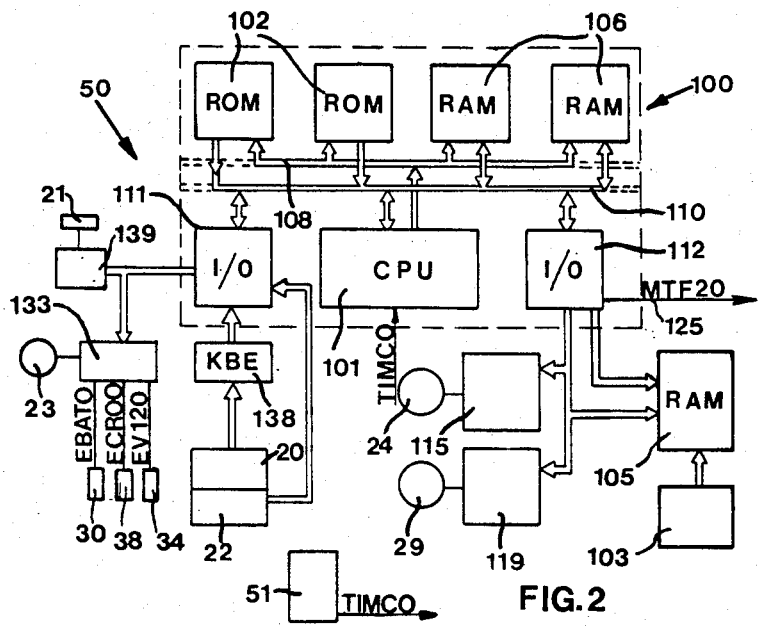
FIG. 2 is a block circuit diagram of the logic control unit of the machine of FIG. 1.

The typewriter 10 shown in FIG. 1 is of the type described in the U.S. patent application Ser. No. 58,202, abandoned, assigned to Ing. C. Olivetti & C., S.p.A. and comprises an alpha-numeric keyboard 20, a control console 22, a display device 21, a typing platen 26, a serial print unit 25 and an electronic control unit 50 (FIG. 2).

The platen 26 is rotated for line spacing by a motor 23 and the unit 25 is advanced incrementally and parallel to the typing roller 26 by means of a motor 24, acting through wires 31, on guides 27. The unit 25 comprises a character-carrying member 28 of the daisy wheel type, which is rotated incrementally by a motor 29 for selecting the character to be printed, a striker hammer 30 and a typing ribbon 33 which is carried by a cartridge 32 and which is raised for the printing operation by a solenoid 34. The unit 25 further comprises a correcting ribbon 39 which is raised for the correction operation by a solenoid 38. In turn, the control unit 50 (FIG. 2) is of the type described in our prior specification.

Referring to FIG. 3, the keyboard 20, besides the normal alpha-numeric keys 57, also comprises the following operating keys: margin set and storage 58, margin clear 59, tab stop cancellation (TAB-CLEAR) 61, tab stop setting (TAB SET) 77, centering (CENTER) 70, tabulation (TAB) 78, repeat (REPEAT) 62, space bar 65, carriage return with line space 60 (RETURN), carriage return without line space (INDEX) 67, return movement by one character (BACK SPACE) 66, cancellation (CANCEL) 64, page layout selection (P) 69, set phrase selection (M) 71 and line form selection (LINE FORM) 72. In addition, the keyboard 20 also comprises a coding and high-speed movement key (EXPRESS) 76, a table formation key (COLUMN LAYOUT) 73, a page end key (PAGE END) 74, and a relocation key (RELOC) 75. The mode of operation of these keys will be described below.

The unit 50 (FIG. 2) comprises a microprocessor 100, two control units 115 and 119 respectively for the motor 24 and the selection motor 29, actuating circuits 133 for the hammer 30, the solenoids 34 and 38 and the motor 23, a time delay unit 61, the control console 22, a keyboard encoder (KBE) 138, and a control circuit 139 for the display device 21.

The microprocessor 100 is of known type and comprises: a central unit (CPU) 101; two ROMs 102 for storing the sequence of micro instructions, two working RAMs 106 which are used for temporary storage of the data, and input/output (I/O) units 111 and 112 for the exchange of data and commands with the logic units 115, 119, 133, 138 and 22. The unit 50 further comprises a RAM 105 which is made non-volatile by means of a back-up battery 103.

The console 22 comprises a key 83 (FIG. 1) for switching the machine on and off, a selector 81 (FIG. 3) for selecting the line spacing pitch from one, two, three or four elementary line spaces, a selector 80 for selecting one of the spacings of 1/10"; 1/12", 1/15" (2.5 mm, 2.1 mm or 1.7 mm) or proportional spacing, and a selector 90 for selecting a machine state STORAGE which permits recording of the data in the non-volatile memory 105 and a machine state TPWR relating to normal typing.

The memory 106 comprises a buffer having the capacity for storing the positions of the unit 25 for two lines of characters. The buffer stores the codes of the symbols which are introduced by the keyboard and which are printed or in the process of being printed by the machine in the line of typing in the course of setting and in the preceding line. These codes identify in particular the information required for printing the character occupying that position, if the character is underlined, if it is in heavy type, or if it is superimposed on the following character, and also if the character is a space or if it is to be printed in a special way.

The non-volatile memory 105 is of a capacity capable of containing: the parameters of the current model or standard line (the last line used), the parameters of at least three model lines of more current use, the number of line spaces for automatic insertion of a sheet on the roller 26, and data relating to page end signalling. The memory 105 is also provided with a portion which can contain a series of character and/or instructions for set phrases and page forms, which is so organised that it can be subdivided down to ten positions for set data and ten positions for model pages, each of variable capacity compatible with the total capacity envisaged for that part of the memory. Either the set phrases or the page forms are selected, by means of actuation of the corresponding key 71 or 72, followed by the desired number of the memory.

The display device 21 has a capacity of two characters and is capable of displaying in both positions, besides all the numbers from 0 to 9, some signs and letters of the alphabet. This display device is used as a guide for the operator and provides useful information in various operating phases of the machine. The main function of the display is in particular that of a down counter for charaters, for signalling a usable typing area to the operator.

In the TPWR operating mode, the information relating to positioning of the print unit 25 and thus the positions of margins and stops is taken from a predetermined region of the memory 105. When the machine is switched on, the last model line used is always selected, namely, that line which was present when the machine was previously switched off and which was memorised in the 'current line' position in the memory 105. In a case in which the line forms parameters are lacking, the machine automatically fixes the left-hand margin and the right-hand margin on the physical margins of the unit 25.

The present model line can be replaced by one of those which has been previously stored in the non-volatile memory. This is effected by actuating the LINE FORM key 72 (FIG. 3), followed immediately by the numbers 1, 2, 3 corresponding to the desired model line. The machine then automatically effects replacement of the parameters of the present line by that which had been stored in the recalled position, which will thus become the fresh current line. The unit 25 will take up a position at the left-hand edge of the fresh model line.

The display device 21 carries out its function as a character down-counter, whereby the number which is present upon actuation of LINE FORM 1, 2, 3 is replaced by that relating to the number of characters available in the fresh model line, consistent with the spacing selected by the selector 80.

The model line may be modified and/or replaced during the TYPWR operating mode of the machine, by suitable TYPWR operating mode of the machine, by suitable keyboard actuation. In particular, total cancellation of margins and stops in respect of the current line is effected by actuation of LINE FORM 72 and CANCEL 64, at any point whatever in the line. This will also cause the typing head to assume a position at the left-hand physical margin. Total cancellation of all the tab stops, while maintaining the margins, is effected by actuation of TAB CLEAR 61 and REPEAT 62, at any point whatever in the line. Such actuation will also cause the head to take up a position at the left-hand margin present at that moment in the machine.

The present model line can also be replaced by a line which has been set by means of the COLUMN LAYOUT selector 73. Such a procedure will allow the operator to automate the setting of the stops of a table, without any particular space calculations having to be performed. This is effected by actuation of that key, which is of the luminous type, which causes predisposition of the machine for operation in blind or blank typing, without yet cancelling the current model line. The content of the longest line of each column is then typed by actuating the key TAB SET 77 at the end of each line relating to each column. The fresh model line thus being set in the RAM 105, by again actuating the COLUMN LAYOUT key 73, the key becomes inoperative and cancellation of the current line is effected by the RAM 106, together with substitution thereof by a fresh model line which replaces the current line.

The fresh line form automatically positions the stops and the margins in such a way that there are two spaces between the longest line of each column and the beginning of the following column. The machine centres the fresh margins with respect to the margins of the previous line and other possible predispositions present at that moment ae disregarded.

The keying actuation operations carried out in the column layout phase take place in blind or blank type; the display 21 counts down the characters in a manner which is consistent with the model line present before the column layout keying action, thus warning the operator of possibly overrunning the right-hand margin.

The display 21 essentially indicates the number of characters between the position of the head and the right-hard margin. This information is real in the case of typing which is simultaneous with the input of data, and theoretical in the case of blind or blank typing or in the case of the keyboard buffer being occupied. When the indication exceeds the 99 characters, which is the maximum number that can be displayed, the sumbol '- -' will appear at the display 21, until the number to be displayed falls to 99. When, as already described in our prior specification, the print unit 25 is in the hot area for typing in ADJUST, at eight characters from the right-hand margin, besides the acoustic signal, the display 21 is caused to flash, the display continuing to count down until the right-hard margin is reached. Running over the right-hard or left-hand margin, which is achieved by a margin by-pass key 91, is signalled at the display 21 by the symbol '-' as the left-hand digit if the unit 25 is in the area beyond the left-hand margin, or as the right-hand digit if it is in the area beyond the right-hand margin. In general, any error signalling is also signalled, besides acoustically, by the appearance in the display 21 of a flashing 'E' which is then eliminated by one of the back-space, new line, etc keys, which cause cancellation of the error. The display preceding the error then appears at the display 21.

Similary to the machine disclosed in our prior specification the machine of the present invention enjoys the possibility of removing or re-covering a character which has been typed by error in the line which is in the course of typing, in an automatic mode, by actuating the CANCEL key with the head positioned at the character to be cancelled. This is also effected in repeat by means of the REPEAT key 62. Automatic cancellation is also possible on the line preceding the line being typed, in addition to the latter line. For this purpose, the EXPRESS key 76 is actuated, followed by REPEAT 62. This causes a return to the memory and actuation of the motors 24 and 29 in order to position the unit 25 at the first character of the preceding line. The last position of the unit 25 is retained, while the display 21 also shows the preceding line signal 'PL', which remains active throughout the period for which the working point of the machine will be disposed at the preceding line. By actuating the spacer bar 65 and the back space key 66, the unit 25 is positioned at the point to be corrected, and operation is then effected as for a correction operation on the line in the course of being typed, in the manner described in our prior specification.

The machine is provided with a means which, after correcting a character, automatically positions the typing unit 25 at the last point of typing. This operation is effected by actuating the RELOCATE key 75. This causes actuation of the motor 24 and possibly the motor 23 for moving the unit 25 from the current position to the previously retained position. Actuation of the RELOCATE key after a blind or blank typing phase also causes printing of the actuated zone in the blind or blank mode with positioning of the unit 25 at the last character printed.

In accordance with another characteristic, the machine may provide for manual cancellation operation, by making use of the correcting ribbon device in regions of the text which have not been stored in the buffer. This is effected in a similar manner to that described in our prior specification by putting the unit 25 to the character to be cancelled, by means of manual movement of the typing roller, bar and back space, and actuating the CANCEL key 64 and the key of the character to be cancelled. Actuation of the key of the character causes a forward movement of the unit 25, such movement also being in proportional spacing, which is equal to that produced during a normal typing cycle. In this way the print unit 25 is automatically positioned at the character to be cancelled and it is then possible to carry out the cancellation operation in respect of a plurality of letters in succession, without any necessity for the head to be re-positioned to the adjacent character. When the character to be cancelled is formed by the superpositioning of two characters, for example Ø, the sequence will be: CANCEL followed by the first character, CANCEL followed by BACK SPACE 1 and second character.

Different actuation operations from CANCEL followed by a character or BACK SPACE 1+ character will be performed normally and will cause the machine to come out of the cancellation condition.

In accordance with another feature, the machine is provided with a means for positioning the print unit 25, which permits characters, words or phrases to be automatically inserted, in a region of spaces which is between two typed regions. In order to perform this function which is referred to as 'INSERT', the unit 25 is moved to any position in the region of spaces between two typed regions. The keys CENTER+0 and REPEAT 62 are then actuated, which cause predisposition of the machine for blank or blind typing and display of the letter 'C' at the display 21. The character, word or phrase to be inserted is keyed in in the blank typing mode, while indication of the usable area for typing is displayed at the display 21.

By actuating one of the keys RETURN 60, INDEX 67 or TAB 78, the actuated characters are then printed, being compressed or expanded when necessary in order to insert the insert portion into the available space. In particular, the spaces to the right and to the left are reduced so as to guarantee a minimum of ½ space on each side and, if that still does not permit the insertion, the spaces are reduced between one word and the next, until a minimum of ½ space between one word and the next is guaranteed. Alternatively, if the space is greater than that available, the corresponding spaces are increased, with the same criterion being followed as for contraction of the spaces.

This 'INSERT' operation provides for automation of the half pitch function and for centering titles between two stops, further assisting in automatically typing tables.

In accordance with a further characteristic, the machine may store in the RAM 105 the number of elementary line spaces of the platen 26 which may be typed on the sheet, for example starting from the upper edge of the sheet. The machine then indicates at the display 21, some line spaces in advance, that the machine is first approaching and has then reached the end of the page. In order to activate this signal, the PAGE END key 74 is actuated, which causes the machine to begin to count down in respect of the elementary line spaces stored in the memory, at each new line with line spacing (RETURN), thereby to ensure that the count down will be independent of the line space value selected by the selector 81.

Precise indication that the machine is approaching the edge, consistently this time with the selected line space, will be displayed by the display device 21 at three line spaces from the page end, when actuating RETURN, by the signal −3. This signal is then replaced by the normal signal (number of characters which can be used for typing), upon the first actuation of an alphanumeric key 57. This display decreases at each line space until it reaches zero. On the other hand, if with the signalling already activated, the line space value is changed, the machine continues to provide a corresponding signal. If that is not possible, it no longer provides any signal when zero is reached, any carriage return command is prevented and the error signal will appear at the display 21.

The machine state STORAGE which is selected by the selector 90 permits the non-volatile memory 105 to record three model lines of more recurrent use, parameters for the page end signalling means, model page parameters for the page end signalling means, model page parameters and words and/or phrases of recurrent use. In order to record the line form, after the machine state selector 90 has been moved to the Storage position, LINE FORM 72 is actuated, followed by 1, 2, 3. This operation predisposes the memory in question to replace its own content by that of the current line. Actuation of Line Form will also cause the signal 'LF' to appear at the display 21. When LINE FORM is again actuated, the start is give for the actual registration operation, also eliminating the signal LF at the display.

In order to store the number of line spaces in the memory, the PAGE END key 74 is actuated, causing the symbols PE to appear at the display. The desired line spaces are then actuated by means of the New Line or Index and finally the PAGE END key is also operated, which causes actual registration of the line spaces actuated, and the removal of PE at the display. Alternatively, after actuating the PAGE END key, the number corresponding to the desired elementary line spaces is actuated. When the PAGE END key is again actuated, the old information is replaced by the new, and the signal PE disappears from the display.

In order to record parameters of the model page, the page layout key (P) 69 is actuated, plus the number relating to the region of the memory 105 in which the page form is to be introduced. The memory has ten memory regions p1, p2, etc. which can be selected, with numbers from 0 to 9. Such actuation causes the number relating to the total available memory capacity to appear at the display 21. The print unit 25 is moved into the desired stop position and the key 69 is actuated. The machine registers the co-ordinates of the point in elementary spaces and in elementary line space units. Operation is similar for recording set phrases, by means of the key (M) 71, in regions M1, M2, etc.

In the event of errors occurring during each recording operation, actuation of the CANCEL key will cause resetting of the predisposition (and also of the display), if it immediately follows actuation of the predisposition key. If however it follows actuation of the numeric key, the predisposition is maintained but the information inputted is cancelled. Repeated actuation of the CANCEL key will cancel the predisposition, even after input of the numeric information.

Figures 7, 8:
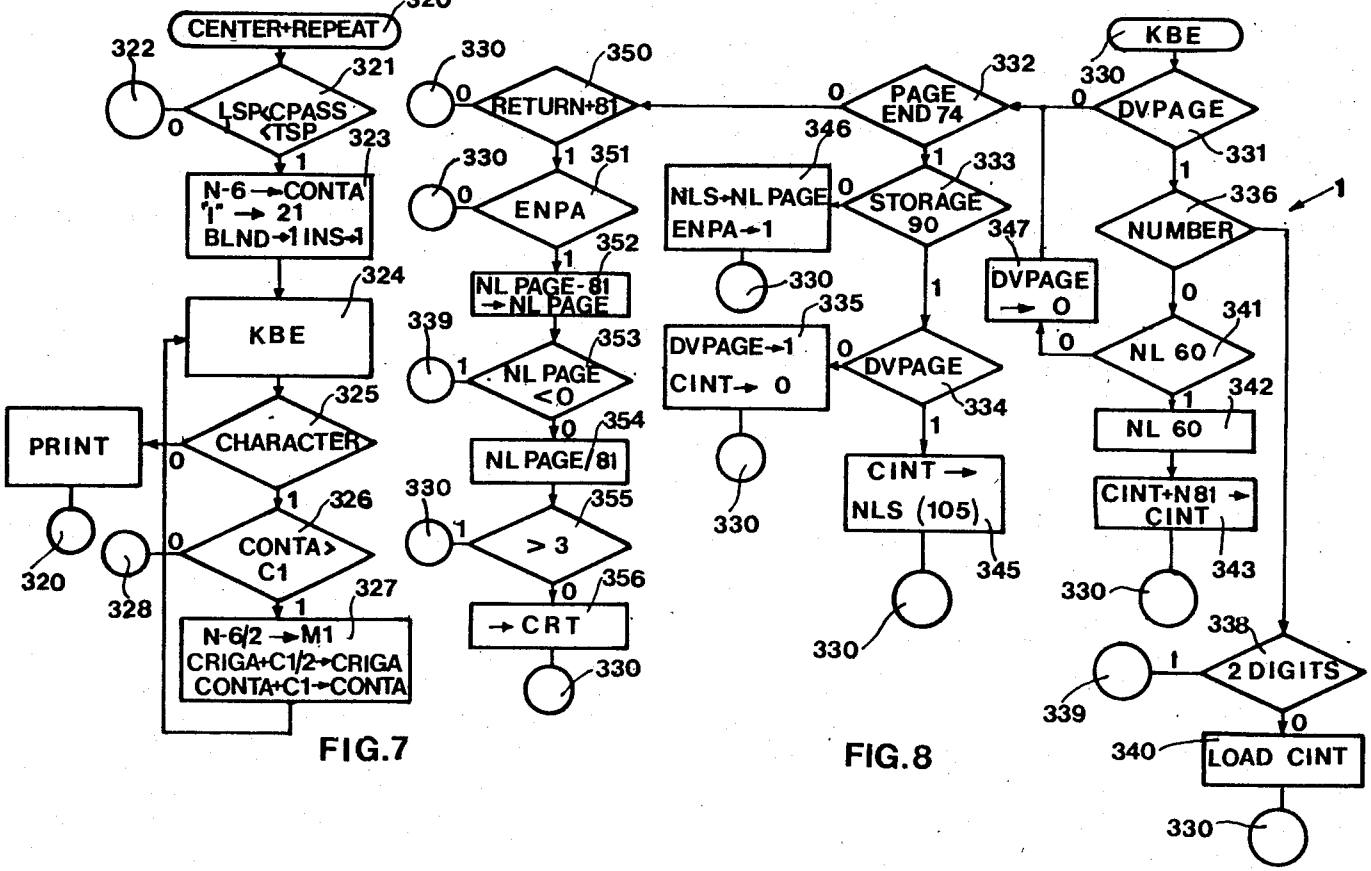
FIG. 7 is a flow chart of an operation of the typewriter of FIG. 1.
FIG. 8 is a flow chart of another operation of the typewriter of FIG. 1.

According to the cited U.S. patent application Ser. No. 58,202, the memory 105 (FIG. 4) comprises a buffer 160 wherein the present printing line is stored. The FIG. 7 shows the flow diagram of centered insertion of words. In particular, actuation of center 70 and repeat 62 key (point 320) causes the program to control on 321 if the position of printing unit 25 represented by C PASS is in the insert zone void of characters between the positions of last printed LSP and first printed FSP characters. In the negative, it is signalled on 322. In the positive, a difference number N of elementary 1/60" spaces contained in the insert zone are revealed. The number 6 corresponding to a large space (to be splitted to 3 half spaces) is subtracted from N and the result is stored on CONTA cell of RAM 105. Symbol "I" is displayed on display 21 and stores BLND and INS of blind writing and insert made are set to 1. Thereafter, through the general KBE keyboard entry routine 324, revealed depression of a character key, branch 325 controls if C1 spaces of the entered character are less than CONTA. In the negative an error appears on 328. In the positive, the program goes to block 327 which is substantially equal to the routine provided for the centering of a title between margins on cited patent application 58,202. Briefly the block 327 relates to calculate and store on MI the half of N−6, to the store of entered character on a CRIGA point of buffer 160 defined by MI, the addition of a number of spaces to the left of inserted character equal to MI-C$\frac{1}{2}$, with following shift of entered characters and the accumulation of C1 on CONTA and of remaining half of C1 on CRIGA.

Each time a new character is imposed, the stored and not written characters of the buffers are displaced to the left by on half the space C1 of this digitized character and CRIGA is increased each time remaining half the space C1. The spaces of the characters are furthermore accumulated on CONTA, are displayed on display 21 and are compared with the reference length, an error signal being produced in the case of overflow. When, on branch 325 a service key is recognized as print, routine starts which causes the carriage or print head 25 to become displaced to the calculated position at which the first letter of the title is to be printed and will subsequently carry out print from the buffer of the stored characters.

For the signalling of the end of the page, RAM 106 (FIG. 2) comprises a CINT and a N LINE counters for the elementary line spaces and a D V PAGE and ENPA stores. Moreover non volatile RAM 105 stores on NLS the up two digits number of elementary spaceline to be recorded. According to FIG. 8, the storage of the page includes on point 330 of keyboard entry the passage by branches 331 and 332 which verifies on the D V PAGE store, depression of PAGE end key 74, the status of STORAGE of selector 90. In the negative, when depressed keys and set selectors are different by PAGE end 74 and STORAGE 90 the program follows to KBE 330 for the specific routines. In the positive, the microprogram through sets D V PAGE to 1 on point 335 and CINT to 0 on point 335 and returns to KBE 330 after the confirm on branch 334 that D V PAGE is 0. If a numerical key is now depressed, the program verifies it on branch 336, controls on branch 338 that no more than another digit was present on CINT for a two digits number has been depressed, loads this number on CINT displays it on display 21 (point 340) and returns to KBE 330, whilst on error is signalled on 339 if two digits was already stored.

As described, the store on CINT may be effected by the repeated depression of RETURN or NEW LINE key 60. Through branches 336 the microprogram controls on 341 that this key 60 has been depressed, proceeds on 342 to execute the new line routine with rotation of the roller 26 from one to four elementary line spaces according to the position of selector 81, accumulates on CINT (point 343) the number of selector 81, displays it on display 21 and returns to KB3 330. If return key 60 is revealed not depressed on Branch 341, the program sets DV page to 0 on 347 and follows to Branch 332".

The storage of the number of line is completed when the second depression of PAGE end key 74 with D V PAGE to 1 causes on block 345 the load of CINT on non volatile memory 105, the reset of D V PAGE to 0 and the return to KBE 330.

When now the selector 90 is to normal stage, depression of PAGE end key 74, through branches 332 and 333 causes on block 346 the transfer of stored number of lines from NLS of 105 to N L PAGE of 106, the set of 1 of ENPA store and the return to 330.

Each depression of RETURN or NEW LINE key 60, through branches 350 and 351, causes the set number on selector 81 to be subtracted from N L PAGE counter on block 358. The program follows to divide N L PAGE by the set number on selector 81 through branch 353 and block 354 and displays the result on display 21 if it is 3, through branch 355 and block 356. Block 357 reveals the error when on branch 353 the end line has been exceeded.

What I claim is:

1. An electronic typewriter comprising line spacing means actuatable for line spacing a recording sheet;

selection key means for selecting a line space pitch as a set multiple of an elementary line step;

a line space command operable to actuate said line spacing means according to said set multiple of an elementary line step;

a line space memory capable of storing a number of elementary line steps which can be typed on the recording sheet;

a control circuit responsive to each operation of said line space command, to said line space memory and to a selected line space pitch for calculating a number of permitted operations of said line spacing command which can still actuate said line spacing means before the last line to be typed on the recording sheet;

comparing means for comparing said number of permitted operations with a given reference number of lines; and a display device controlled by said control circuit and by said comparing means to display said number of permitted operations when said number is not more than said reference number of lines.

2. An electronic typewriter according to claim 1 further comprising first memory for storing a remaining number of elementary line steps remaining before the last line to be typed and wherein said number of permitted operations is obtained by dividing said remaining number of elementary line steps by said set multiple of an elementary line step.

3. An electronic typewriter according to claim 2, wherein said number of permitted operations changes in response to each new set multiple of elementary step selected by said selection key means.

4. An electronic typewriter according to claim 1, further comprising first key means actuatable to define either a storage mode or a normal mode and second key means actuatable in said storage mode for causing said line space memory to store said number of elementary line steps.

5. An electronic typewriter according to claim 4, wherein said display device responds to said storage mode and to said second key means for displaying said number of elementary line steps and responds to said normal mode to display said number of permitted operations when said number is not more than said reference number of lines.

6. A typewriter according to claim 1, wherein the control circuit prevents actuation of the line space commands after typing the last inputted line.

7. An electronic typewriter according to claim 1, wherein said memory is a random access memory rendered not volatile by a back-up battery.

8. In an electronic typewriter comprising line spacing means actuatable for line spacing a recording sheet, selection key means for selecting a line space pitch as a set multiple of a line step and a line space command operable to actuate said line spacing means according to said set multiple of a line step, the combination comprising:

first key means actuatable for defining either a storage mode or a normal mode;

a line space memory;

second key means actuatable in said storage mode for storing in said line space memory a number of line steps which can be typed on the recording sheet;

a display device responsive to said storage mode and to said second key means for displaying said number of line steps;

first memory means for loading therein said number of line steps;

control means responsive to each actuation of said line space command and to said set multiple of a line step to subtract the set multiple of a line step from said number of line steps in said first memory means to find a remaining number of line steps remaining before the last line to be typed and to load said first memory means with the found remaining number;

means for calculating a number of permitted operations as a result of a division of the content of said first memory means by said set multiple of a line step;

second memory means for storing said number of permitted operations; and comparing means for comparing said number of permitted operations with a given reference number of lines;

and wherein said display device responds to said normal mode, to the content of said second memory means and to said comparing means to display said number of permitted operations when said number is not more than said reference number of lines.

* * * * *